US008872103B2

(12) United States Patent
Holle et al.

(10) Patent No.: US 8,872,103 B2
(45) Date of Patent: Oct. 28, 2014

(54) LASER SPOT CONTROL IN MALDI MASS SPECTROMETERS

(75) Inventors: Armin Holle, Achim (DE); Andreas Haase, Bremen (DE); Jens Hoehndorf, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 84 days.

(21) Appl. No.: 13/605,620

(22) Filed: Sep. 6, 2012

(65) Prior Publication Data

US 2013/0056628 A1 Mar. 7, 2013

(30) Foreign Application Priority Data

Sep. 6, 2011 (DE) ..... 10 2011 112 649

(51) Int. Cl.
*H01J 49/40* (2006.01)
*H01J 49/16* (2006.01)
*H01J 49/00* (2006.01)

(52) U.S. Cl.
CPC ..... *H01J 49/0004* (2013.01); *H01J 49/164* (2013.01)
USPC ..... 250/282; 250/287

(58) Field of Classification Search
CPC ..... H01J 49/0004; H01J 49/164
USPC ..... 250/288, 458.1, 251, 281
See application file for complete search history.

(56) References Cited

U.S. PATENT DOCUMENTS 5,986,761 A * 11/1999 Crawforth et al. ..... 356/600
6,414,306 B1 7/2002 Mayer-Posner et al.
6,734,421 B2 * 5/2004 Holle et al. ..... 250/287
6,956,208 B2 * 10/2005 Reilly et al. ..... 250/288
7,235,781 B2 * 6/2007 Haase et al. ..... 250/288
7,262,841 B2 * 8/2007 Truche et al. ..... 356/153
7,408,152 B2 * 8/2008 Holle et al. ..... 250/288
7,504,640 B2 3/2009 Franzen et al.
7,667,196 B2 2/2010 Schurenberg et al.
7,872,223 B2 * 1/2011 Yamaguchi ..... 250/281
8,044,344 B2 * 10/2011 Naya et al. ..... 250/281
8,237,113 B2 8/2012 Schurenberg (Continued)

FOREIGN PATENT DOCUMENTS

JP 08148116 6/1996

OTHER PUBLICATIONS

GB Office Action.

(Continued)

*Primary Examiner* — Nikita Wells
*Assistant Examiner* — Johnnie L Smith
(74) *Attorney, Agent, or Firm* — O'Shea Getz P.C.

(57) ABSTRACT

Mass spectrometers ionize samples by matrix-assisted laser desorption (MALDI). The samples are located on a moveable support plate, and irradiated by a pulsed laser. A fast positional control of laser spots is provided via a system of rotatable mirrors to relieve strain on a support plate motion drive. If the spot position is finely adjusted by the mirror system and follows the movement of the sample support plate, the intermittent movement of the sample support can be replaced with a continuous uniform motion. The fast positional control allows more uniform ablation of a sample area. Galvo mirrors with low inertia may be used between the beam generation and a Kepler telescope in the housing of the laser. The positional control can also provide a fully automatic adjustment of MALDI time-of-flight mass spectrometers, at least if the ion-optical elements are equipped with movement devices.

13 Claims, 2 Drawing Sheets

(56) References Cited

U.S. PATENT DOCUMENTS

| | | | | |
|---|---|---|---|---|
| 8,274,042 | B2 * | 9/2012 | Holle | 250/282 |
| 8,431,890 | B1 * | 4/2013 | Haase et al. | 250/288 |
| 8,581,179 | B2 * | 11/2013 | Franzen | 250/282 |
| 8,605,968 | B2 * | 12/2013 | Alexandrov | 382/128 |
| 2004/0183006 | A1 | 9/2004 | Reilly et al. | |
| 2004/0183009 | A1 | 9/2004 | Reilly et al. | |
| 2005/0056776 | A1 | 3/2005 | Willoughby et al. | |
| 2005/0236564 | A1 | 10/2005 | Keller et al. | |
| 2009/0020069 | A1 * | 1/2009 | Standifer et al. | 117/204 |
| 2009/0289184 | A1 | 11/2009 | Deininger et al. | |
| 2011/0280455 | A1 | 11/2011 | Alexandrov | |
| 2012/0129201 | A1 | 5/2012 | Suckau et al. | |

OTHER PUBLICATIONS

Spraggins et al., "High-Speed MALDI-TOF Imaging Mass Spectrometry: Rapid Ion Image Acquisition and Considerations for Next Generation Instrumentation", J. Am. Soc., Mass Spectrum, 22:1022-1031, 2011.

* cited by examiner

LASER SPOT CONTROL IN MALDI MASS SPECTROMETERS

PRIORITY INFORMATION

This patent application claims priority from German Patent Application No. 10 2011 112 649.3 filed on Sep. 6, 2011, which is hereby incorporated by reference in its entirety.

FIELD OF THE INVENTION

The invention relates to mass spectrometers with ionization of samples by matrix-assisted laser desorption (MALDI), wherein the samples located on a moveable support plate are irradiated by a pulsed laser.

The invention provides a fast positional control of laser spots via a system of rotatable mirrors to assist the support plate motion drive, which by its high inertia is not able to follow a fast movement from sample to sample during a fast sequence of analyses. If the laser spot position is, in a microscale, controlled by the mirror system and follows the motion of the sample support plate, at least in phases, the stepwise movement of the sample support can be replaced by a continuous movement, preferably at uniform speed. Furthermore, the fast positional control of the laser spots allows for a more uniform ablation of a sample surface for improved utilization of the analyte molecules of the sample. Preferably, galvo mirrors with low inertia can be used between the beam generation system and a Kepler telescope in the laser housing. Low inertia galvo mirrors, which can be repositioned within the 100 microseconds between two laser shots (i.e. with pulse repetition rates of 10 kilohertz), necessarily have small diameters and can only be used in locations with small laser beam diameter. The optimum location is between the beam generation system and an optical telescope used for the necessary diameter expansion of the laser beam. The positional control can also be used for a fully automatic adjustment of MALDI time-of-flight mass spectrometers, at least if the ion-optical elements, such as reflector and detector, are equipped with movement drives.

BACKGROUND OF THE INVENTION

In time-of-flight mass spectrometers in which the samples are ionized by matrix-assisted laser desorption (MALDI), the laser beam is usually focused by fixed lenses and mirrors onto a sample on a sample support so that an irradiation spot with desired diameter and energy density is produced at a location in the acceleration system of the ion source which is optimally selected for high sensitivity. The sample contains a thin layer of small crystals of the matrix substance in which a small quantity of analyte molecules is embedded. A light pulse from the laser, usually a UV laser, is used to generate a plasma cloud of sample material in which ions of the matrix and analyte molecules are produced. Modern embodiments of MALDI lasers (U.S. Pat. No. 7,235,781) produce not just a single irradiation spot, but a pattern of several irradiation spots simultaneously, whereby the spot diameter and energy density can be optimized in such a way that a hundred times higher yield of analyte ions is achieved. The pattern can contain 4, 9 or 16 irradiation spots in a square arrangement, for example, but also 7 or 19 spots in a hexagonal arrangement. The utilization factor of the samples can be increased by using the sample material more economically. If a different spot on the sample has to be irradiated, the sample has to be moved by a movement of the sample support plate.

A voltage applied to diaphragms in the ion source accelerates the ions into a field-free flight tube. Since the ions have different masses, they are accelerated to different speeds in the ion source. Light ions reach the ion detector earlier than heavier ones. The ion currents are measured and digitized at the ion detector with two to eight measurements per nanosecond. The flight times of the ions are determined from the measured ion current values, and the masses of the ions are determined from the flight times. As is known to those skilled in the art, velocity-focusing reflectors can be used to increase the time-of-flight resolution. In particular, a delayed acceleration of the ions (DE=delayed extraction) can focus ions of one mass efficiently despite the initially broad distribution of their starting velocities brought about by the expanding plasma cloud. Summing 50 to 1,000 individual time-of-flight spectra from a sample to form a sum time-of-flight spectrum, and obtaining the mass spectrum of the sample is well-known Prior Art. Nowadays, mass resolutions of $R=m/\Delta m>50{,}000$ are achieved with good time-of-flight mass spectrometers, in a wide mass range of $1000\ Da<m/z<4000\ Da$. The mass accuracies achieve values of the order of one millionth of the mass (1 ppm).

U.S. Pat. No. 6,734,421 discloses the synchronous acquisition of several mass spectra from several sample locations on a sample support, but without representing an explicit embodiment, is to introduce a beam deflection device for positioning the laser spot on the sample support plate. In the document it is proposed that the beam deflection could work with movable mirrors; piezo-controlled mirrors are expressly mentioned. The sample support should remain stationary while several samples are scanned; the ions of the different sample locations should be imaged onto different detectors. This should make it possible to measure mass spectra of several samples with a temporal overlap. In the document U.S. Published Patent Application 2004/0183009, mirrors are again used for positional control; here they are used to scan inhomogeneously prepared samples in order to find spots with higher ion yield ("sweet spots"). Also in U.S. Published Patent Application 2005/0236564 A1 a rotatable mirror is used to control the position of the laser spot in a direction vertical to the mechanical movement to generate a scanning raster. These solutions, however, do not consider fast spot control, using lasers with repetition rates up to 10 kilohertz, and moving the laser spot in the time span within two laser shots. In all these documents, relatively large mirrors were positioned near the optical lens system focusing the beam onto the sample. These mirrors have a relatively high inertia and cannot be redirected within 100 microseconds. Commercially available time-of-flight mass spectrometers with positional control for laser spots have not yet been developed.

Over the years, the laser technology for MALDI time-of-flight mass spectrometers has improved enormously. Not only has the division into several laser spots been introduced and become widespread under the name of "smartbeam"; the laser shot frequency has been constantly increased from initially 20 shots per second with nitrogen UV lasers to today's 1,000 to 5,000 shots per second with solid state UV lasers. The current goal is a repetition rate of 10 kHz, which means that only 100 microseconds are available for the acquisition of a time-of-flight spectrum, and also for the positional changes of the laser spots. With five ion current measurements per nanosecond at the detector, a single time-of-flight spectrum then consists of 500,000 measured values, enough for a mass resolution in the order of 50,000, and a mass accuracy of one part per million. As has already been mentioned, at least 50 to 1,000 individual time-of-flight spectra, which are added together at every mass position to fowl a sum time-of-flight spectrum, are acquired on one sample. This is then used to obtain the mass spectrum of the sample.

This technique with high laser shot rates is used especially in "imaging mass spectrometry" of thin tissue sections, with which many ten to hundred thousands of mass spectra are acquired from one thin tissue section. Just as an original color image contains a full color spectrum in each pixel, so a mass spectrometric image contains a full mass spectrum in each pixel. Pixel separations from 50 down to 20 micrometers are being used today, and the aim for the future is a spatial resolution of 10 or even 5 micrometers. 40,000 mass spectra are obtained from one square centimeter of thin tissue section at 50-micrometer resolution; at 10-micrometer resolution it is already a million mass spectra. In this case also, for the mass spectrum of one pixel, the individual flight-time spectra from 50 to 1,000 laser shots are added together to form a time-of-flight sum spectrum, from which the mass spectrum of the pixel is then obtained. The larger the number of individual time-of-flight spectra added together in each case, the better will be the detection limit and the signal-to-noise ratio. However, it is not always possible to acquire and add together any number of individual time-of-flight spectra because the sample is usually quickly exhausted.

The current state of the art is that these mass spectra are acquired with the laser spot or the laser spot pattern having a fixed position relative to the axis of the ion source. The spatial resolution is produced solely by the movement of the sample support plate. The required flatness of the surface means that the sample supports are quite bulky, with high inertia when taken together with the holder. The stepping movement of the sample support plate from sample site to sample site thus results in an extraordinarily high load for the movement device, which in general consists of a stepper motor and a threaded rod. At present, the sample support is moved with up to 10 sample sites per second; with 10 kHz lasers of the future it will have to be up to 200 sample sites per second and more, a movement which can no longer be achieved mechanically. As a solution for imaging mass spectrometry, attempts are already being made to work with a continuous movement of the sample support plate through a fixed laser spot position. This achieves a compromise between speed of forward movement and laser shot frequency in order to obtain a reasonably useful signal quality; moreover, the utilization of the sample is greatly limited. This operating mode, however, is not satisfactory for imaging mass spectrometry [see J. M. Spraggins and R. M. Caprioli, J. Am. Soc. Mass Spectrom. (2011) 22:1022-1031].

Moreover, uniform utilization of the available surface of a sample site, and thus utilization of the available analyte molecules for the acquisition of the individual time-of-flight spectra, is not very satisfactory at present. For example, nowadays, thin tissue sections for ionization by matrix-assisted laser desorption (MALDI) are prepared by applying a layer of tiny crystals of matrix material to the thin section; the soluble peptides and proteins are transported from the thin section into the top layer of the crystals. If the spot pattern is not moved, the analyte molecules under the laser spots are exhausted after three to five laser shots. Therefore, nowadays, the spot pattern is rotated with a swaying motion in order to repeatedly ablate as yet unused sites. To date, however, it is only possible to achieve really uniform ablation of a specified sample surface by moving the sample support plate. But the high frequency required for these movements is impossible to achieve today with the movement device for the sample support plate.

There is a need for a device for moving the sample support from fast, intermittent movements, both for the analysis of samples in high spatial density, as in imaging mass spectrometry, for example, and for the uniform ablation of the samples on specified areas.

SUMMARY OF THE INVENTION

The invention provides a laser system with fast positional control of the laser spot on the sample support plate as the basis for relieving the strain on the support plate motion drive. There is, however, a problem regarding the production of very fine laser spots of only a few micrometers in diameter. On the one hand, the optical lens system for generating the laser spot must be mounted at a considerable distance from the sample support plate in order to prevent sample material from being deposited on it. In order to generate a sufficiently small laser spot on the sample support plate in the ion source of the mass spectrometer, it is necessary, in accordance with the laws of optics, to use an optical lens system with long focal length and large aperture in combination with a laser beam expanded in diameter. On the other hand, for fast positional changes within a time frame of around 100 microseconds, it is necessary to use very small mirrors with low inertia; these must therefore be used before the necessary expansion of the laser beam, i.e. they cannot be positioned within this expanded laser beam. The problem can be solved by using a mirror system, e.g. with small galvo mirrors, in the inside of the laser system in front of a Kepler telescope designed to expand the laser beam in such a way that the angular deflection of the thin laser beam is transformed through the telescope and the optical lens system into a change in the spot position. Ready-to-use mirror systems are available commercially, and allow a deflection in two directions. All mirrors show a statistical noise of their movement; the smaller the mirrors, the higher the noise. Therefore, the telescope has to reduce the beam angle generated by the small mirrors to increase the precision of the positioning. Furthermore, the telescope has to redirect the widened beam centrally into optical lens system in such a way that the reduced angular deflection brings about the requested change in the spot position. The laser system therefore contains the aforementioned mirror system in addition to the actual device for generating the laser beam from the laser crystal, and a device for multiplying the laser light frequency; furthermore, it contains the special telescope for expanding the beam and the large aperture optical lens system for focusing the expanded beam onto the laser spot. In addition, the laser system may contain a pattern generator to generate a spot pattern comprising 4, 7, 9, 16 or 19 individual laser spots, for example. If UV light is used for the ionization, all lenses in the telescope, the optical lens system and the pattern generator must preferably be manufactured from pure silica glass.

The rapid positional control allows optimal utilization of all the analyte molecules from a specified area of a sample (the "sample site") by uniform ablation of the sample within this area with a single laser spot, or preferably with a laser spot pattern, without having to move the sample support plate in order to produce the spatially shifted pattern for the ablation. The uniform ablation of samples on the slowly moving sample support plate may be obtained by controlling the laser spot to ablate the sample in a narrow raster of points, point after point. If a laser spot pattern is used for this uniform ablation, the spot pattern and the raster pattern may overlap each other.

In order to acquire mass spectra of different sample sites sequentially, the positional control for the laser spot allows the sample support to be moved continuously, preferably at a uniform speed in one direction while, by moving the laser beam, the spot position is made to follow in such a way that individual single shot time-of-flight spectra are obtained from the same sample site for each mass spectrum. Therefore, in this phase, the relative movements between sample support plate and laser spot have the value zero. The small laser spot movements for uniform ablation of a specified area of the sample site can also be superimposed onto this "following movement". For imaging mass spectrometry, the spatial resolution for the individual mass spectra can be retained, and simultaneously a high degree of utilization for the analyte molecules is achieved. For a subsequent acquisition of a mass spectrum at a different sample site, the spot position is moved to the new sample site by means of a rapid movement of the mirror within a period of only 100 microseconds until the next laser shot. In this phase, the relative movements between sample support plate and laser spot are very different. This mode of operation does, however, require ion-optical corrections to the changing beam path of the ions through the mass spectrometer and corrections to the changed flight times to be made. The sample sites on the sample support plate do not need to be in a one-dimensional row; sample sites which are side by side can also be analyzed by lateral movements of the laser spot. It is thus possible to analyze samples on a number of tracks while the sample support plate is moved uniformly in one direction.

These acquisition methods for mass spectra can be used particularly in the imaging mass spectrometry of thin tissue sections, in the analysis of thin layer chromatography plates, and also other analytical tasks with high sample density.

In various embodiments, the laser spot can contain an intensity pattern. The relative movement is then preferably generated between a centroid of the intensity pattern on the sample support and the sample support itself. This centroid can be a geometric centroid or an intensity centroid, for example. Small-scale relative movements of the intensity pattern with respect to the sample support can also be carried out in this embodiment in order to distribute the sample ablation as evenly as possible over the whole area of a laser spot.

The fast positional control for the laser spots can also be used to solve further problems. It is, for example, possible to achieve fully automatic adjustment of MALDI time-of-flight mass spectrometers with special samples which supply spectra with constant intensity over a sufficiently long period, controlled by programs in the connected computer. This not only makes it possible to automatically determine the best spot position relative to the ion optics of the spectrometer and all necessary correction voltages for the ions from spots outside of this optimum position; it is also possible to optimally adjust elements of the ion optics themselves, at least if these ion-optical elements, such as the reflector and detector, are equipped with movement devices, at least for the time of an adjustment. However, the positioning of elements of the laser system, like the beam focusing optical lens system, can be optimized too, if these are equipped with movement devices.

These and other objects, features and advantages of the present invention will become more apparent in light of the following detailed description of preferred embodiments thereof, as illustrated in the accompanying drawings.

DETAILED DESCRIPTION OF THE INVENTION

As has already been explained above, an objective of the invention is to avoid intermittent movements or fast to-and-fro movements of the mechanically inert sample support plate, including its holder, as far as possible, and to replace it with a low-inertia movement device for the laser light beam. The movement device should be capable of moving the laser spot to a different site in a time of only 100 microseconds, i.e.

between two laser shots (of a laser system with a repetition rate of 10 kHz). A laser system with a repetition rate of 2 kHz requires a time of half a millisecond. In principle, different types of deflection system can be used for the fast positional control of the laser spot or laser spot pattern, such as piezoelectrically moved mirrors or crystals with electrically changeable refraction. However, electrically moved galvo mirrors, as have been developed for laser scanners or laser labeling equipment, are technically most mature and particularly low-cost. At the borderline of today's technique, small galvo mirrors with a diameter of around 4 millimeters can be moved from one angular position to another within 100 microseconds, provided that the angular changes are only small. It is thus possible to suitably shift the laser spot between two shots of a 10 kHz laser in an ideal way. Commercial units each having two of these galvo mirrors are available for deflections in both spatial directions at right angles to the beam. Furthermore, these galvo mirrors have the advantage that they remain in their angular position in the de-energized state, although they are kept there by an angular position transducer with feedback.

Figure 1:
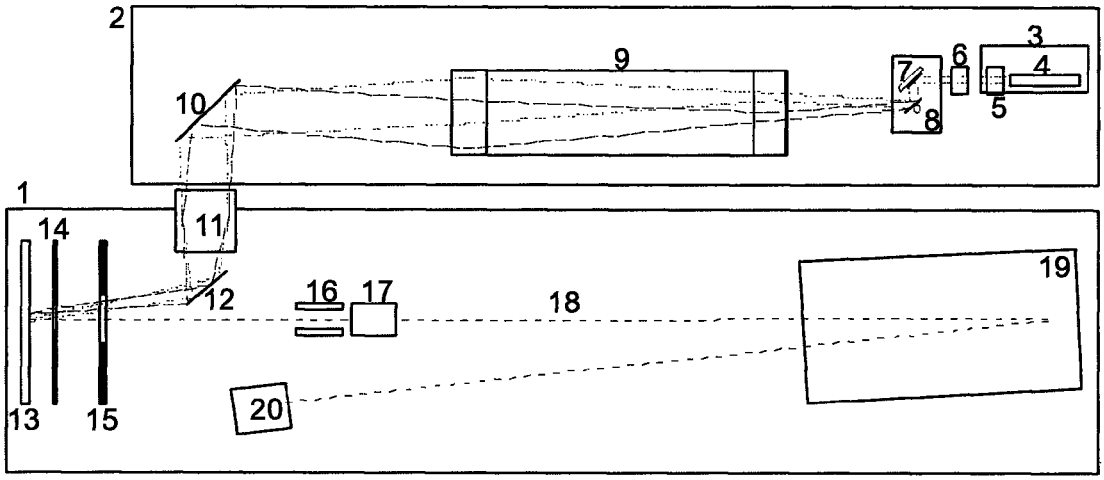
FIG. 1 shows a schematic of a MALDI time-of-flight mass spectrometer with a time-of-flight analyzer 1 and a laser system 2 which controls the laser spot position of the light pulse on the sample support plate 13 with the aid of a mirror system 7, 8. The laser pulse is generated in the beam generation unit 3, which contains a laser crystal 4 and, when necessary, a device 5 to multiply the frequency. It is then split into a spot pattern in the pattern generator 6, and deflected in the mirror system in both spatial directions by two galvo mirrors 7 and 8. The deflected laser beam is then expanded in a Kepler telescope and shifted in parallel in accordance with the angular deflection; the exiting laser beam is directed, with reduced angular deflection, perfectly centrally into the optical lens 11 again via the mirror 10. Depending on the angular deflection, the beam passes through the optical lens 11 centrally but at slightly different angles, thus shifting the position of the spot pattern on the sample support plate 13. The ions generated in the plasma clouds of the laser spot pattern are accelerated by voltages applied to the diaphragms 14 and 15 and form an ion beam, which passes through the two pairs of deflection plates 16, 17 for a trajectory correction and is focused in the reflector 19 onto the detector 20. It should be noted here that the beam guidance within a Kepler telescope 9 is more complex, and the illustration does not reproduce it in real terms for reasons of simplicity. The illustration does, however, correctly reproduce the external effect of the telescope on the laser light beam.

The introduction, however, of these galvo mirrors into the beam path between laser and sample support plate creates a problem and requires a technical solution of some complexity. It is not possible to position the mirrors, which must be small to achieve a low inertia, in spatial proximity to the sample support plate because the laws of optics require that a laser beam must have a large diameter in order to produce a small laser spot using a relatively distant optical lens system. A position in the focused laser beam right in front of the sample support plate is unfavorable because the mirrors would soon be coated with vaporizing or spraying sample material. Therefore, the galvo mirrors have to be implemented in a place where the laser beam has a small diameter. The problem is solved by instead arranging the galvo mirrors 7, 8 in the laser unit 2 itself before any expansion of the laser beam and far away from the sample support plate 13, but in such a way that they still effect a change in the position of the laser spot on the sample support plate 13, as is shown schematically in FIG. 1. This is done by initially generating a pulsed beam of laser light only about 2 millimeters in diameter with the beam generation unit 3, for example with an Nd—YAG laser crystal 4 and a frequency tripler 5 to 355 nanometers (e.g. in the ultraviolet spectral range). The angular deflection of this narrow laser light beam effected by the galvo mirrors 7 and 8 is then converted in a specially designed and manufactured Kepler telescope 9 into a parallel shift of the laser light beam within the telescope 9; the parallel shift is transformed into a reduced angular shift again as the beam leaves the telescope 9. The telescope 9 simultaneously expands the laser beam from 2 to around 16 millimeters. To generate a small laser spot only about 4 to 5 micrometers in diameter on the sample support plate 13, the expanded laser beam must be focused onto the sample support plate with a large-aperture optical lens system 11 with good correction against spherical aberration and other image errors such as astigmatism and coma. The angular deflection of the laser light beam as it leaves the telescope 9, in conjunction with the beam shift, directs the laser light beam perfectly centrally onto the optical lens system 11 again, if adjusted correctly, but now it passes through the optical lens system 11 at a small angle, which results in a shift of the laser spot on the sample support plate 13. The fact that the laser beam passes centrally through the optical lens system 11 is important for the generation of a high quality laser spot with small diameter, because only then are the error corrections of the optical lens system 11 fully effective. It should be noted here that the beam guidance within the Kepler telescope 9 is complex and is not reproduced by FIG. 1 as it actually is; but FIG. 1 does correctly reproduce the external effect of the telescope 9 on the laser light beam.

If a UV laser is used, the high energy density means that all the lenses in the telescope 9 and the optical lens system 11 must preferably be manufactured from very clean, UV-transmitting material such as silica glass. Galvo mirrors 7 and 8 with 4.5 mm diameter have proven to be successful for a laser beam with 2 mm initial diameter; for smaller angular deflections of up to around 5 millirads, they fulfill the requirement for an angular change in only 100 microseconds. The optical lens system 11 has an aperture diameter of around 20 mm. With this optical lens system 11, it is thus possible to generate laser spots with diameters of around four to five micrometers at a distance of around 100 millimeters. This separation between the optical lens system and the sample support plate is advantageous in order to avoid contamination caused by vaporizing or spraying sample material.

Figure 2:
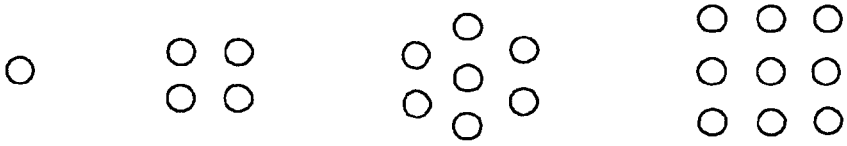
FIG. 2 depicts different laser spot patterns with 1, 4, 7 and 9 individual laser spots. The separations between the spots here are just about as large as the spot diameter, but it is also possible to generate patterns with other separations and spot diameters.

The laser spots or laser spot patterns can be shifted on the sample support plate 13 by around plus or minus 150 micrometers by the galvo mirrors 7 and 8. In this square range of laser spot movement, with an edge length of 300 micrometers, the ions produced there can still be caught by the accelerating ion optics 14, 15 of the ion source and accelerated. When a suitable pattern generator 6 is used, this arrangement can also generate patterns with four, seven, nine or sixteen laser spots, for example, as are shown in FIG. 2, for example. The Kepler telescope thus has to fulfill three tasks: first, to widen the laser beam diameter to completely fill the aperture of the optical lens system for the spot focusing, second, to invert and reduce the beam angle generated by the mirror system, and thirdly, to shift the beam out of its original axis so that it can be redirected exactly into the center of the optical lens system. Beam diameter expansion and angle reduction are coupled and amount here both to a factor of ten. An angle reduction is necessary to reduce the unavoidable noisy movements of the mirrors and to enlarge the precision of spot positioning. In principle, beam diameter expansion and angle reduction can be made to amount to a factor of twenty or even forty, but the original beam diameter generated by the laser has then to be reduced, too, and a diameter of only about 0.4 or even 0.8 millimeter, additionally showing an intensity pattern, will destroy the mirrors by a too high energy density. So an original beam diameter of 1.6 millimeter and a factor of ten for beam widening and angle reduction represent a best compromise. The parallel shift of the beam inside the Kepler telescope can be adjusted by the distance between the mirrors and the entrance of the Kepler telescope.

If, however, the ions are produced slightly outside the axis of the ion optics 14, 15 of the ion source, they are no longer imaged onto the ion detector 20 at the end of the flight path. The ions must therefore be redirected onto the ion detector again by deflection units 16 and 17. Such deflection units here include of two crossed deflection plate pairs 16 and 17; the voltages necessary for the correction amount to several 100 volts and must be supplied by an efficiently controllable voltage generator.

Moreover, ions which are generated outside the axis of the ion source 13, 14, 15 have a slightly longer flight path to the ion detector 20, and thus have an extended time of flight. The extension of the flight path can amount to several micrometers. Since an extension of the flight path by only one micrometer for a total flight distance of two meters already causes an increase of the flight time by half a millionth, equivalent to one millionth of the mass, a correction is required if a high mass accuracy is to be maintained. This can be done with a correction to the time delay of the acceleration, a correction to the voltage in the first acceleration region between sample support plate 13 and the first acceleration diaphragm 14, a correction to the total acceleration, or by another correction of the flight time. Correction voltages for additional accelerations amount to a few volts. The correction of the flight time must then be adapted to the position of the laser spot, in the same manner as the deflection voltage for the trajectory correction at the deflection units 16 and 17.

In principle, it is also possible to take account of the extended flight path computationally when converting flight times into masses. This conversion is usually carried out by parameterized calibration functions. The correction then consists in a change to the parameter values. However, this computed correction cannot be used for this method with a uniformly moved sample support plate, as will be described below, since the individual time-of-flight spectra of different points of origin are first added together to form a time-of-flight sum spectrum. The individual time-of-flight spectra must therefore be corrected before their summation into a time-of-flight sum spectrum; an electrical correction of the flight times, which allows an immediate summation, is thus to be preferred.

Figure 4:
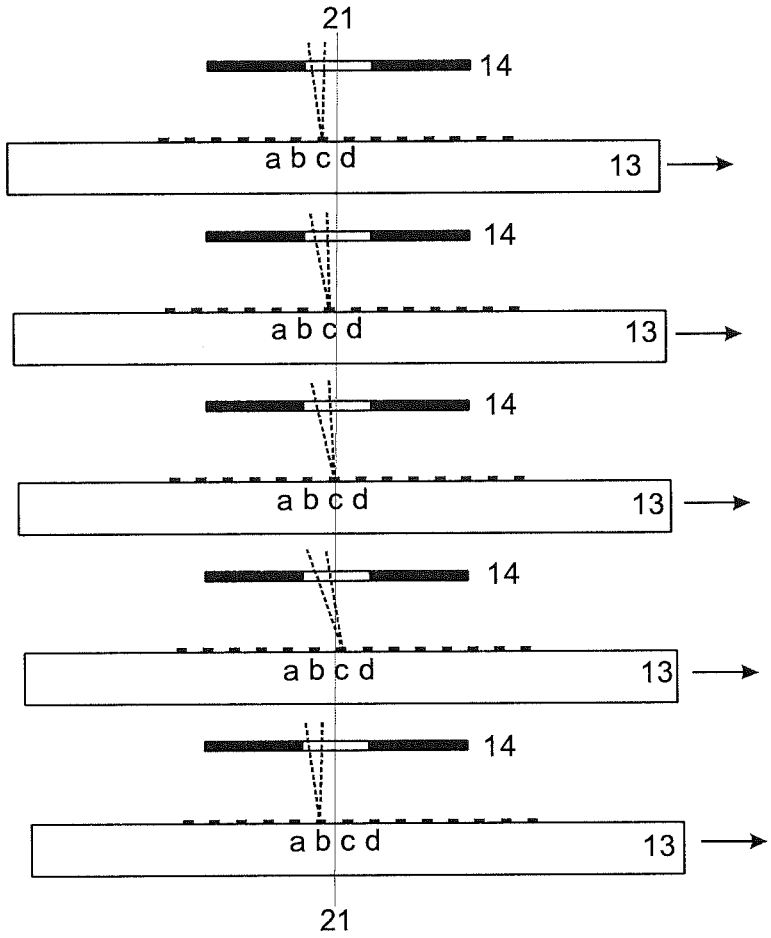
FIG. 4 shows schematically how the laser spot is made to follow a uniformly moving sample support plate 13. The first step is to acquire sufficient individual time-of-flight spectra for generating a mass spectrum from the sample site (c), after which the laser spot is steered onto the sample site (b) and made to follow this sample site until sufficient individual time-of-flight spectra have been obtained from this sample site as well. This process is continued with further sample sites.

In a first example, fast positional control of the laser spot is used to relieve strain on the support plate movement drive during fast sequences of analyses of tightly packed sample sites. The principle for this is shown in FIG. 4. According to the current state of the art, the movement drive for the sample support plate 13, which usually includes a stepper motor and threaded spindle, is unsuitable for a fast sequence of analyses of up to 200 sample sites per second. The intermittent forward transport of the relatively heavy sample support plate from sample to sample puts an extremely strong load on the movement drive and subjects it to heavy wear. The inertia of the system means that significantly more time is required for the movement from sample site to sample site than is available between two laser shots. Thus no mass spectra can be acquired during this time, and the desired spectrum acquisition rate of 10 kHz cannot be achieved. Attempts to move the sample support plate continuously and to scan with an immobile laser spot position have not produced satisfactory results even for imaging mass spectrometry on thin tissue sections; this method cannot be applied at all to individually prepared samples on sample supports, for obvious reasons.

It is now proposed that the sample support plate is moved continuously, for example at uniform speed in one direction, but that the moving sample position is being followed by the fast positional laser spot control in order to obtain the required number of individual time-of-flight spectra from one sample position, for example the sample position (c) in FIG. 4. This phased following of the sample position on the continuously moving sample support 13 means that the individual time-of-flight spectra are obtained from the same sample site (c) and thus no mixing of individual time-of-flight spectra from different sample sites occurs. For imaging mass spectrometry, the spatial resolution of the mass spectrometric image thus can be maintained when the sample support is moved and even if many laser shots have to be obtained from one location of the thin tissue, forming the mass spectrum of the image pixel. However, the location of the ion production is shifted in relation to the flight tube axis of the mass spectrometer, particularly in relation to the axis of the ion-optical arrangement 14, 15 in the ion source; therefore a synchronous ion-optical correction of the changing beam path of the ions must also be carried out, for example with the aid of x-y deflection capacitors 16 and 17 in the ion flight path, and a synchronous correction of the time of flight by additional acceleration voltages. The correction voltages for this deflection and for the additional acceleration must accompany the changes in the laser spot position with respect to the optical axis. For the subsequent acquisition of the mass spectrum from a different sample site, for example sample site (b), which again must be obtained from many individual time-of-flight spectra, the spot position must have moved rapidly to this other sample site (b) and then made to follow again the mechanical movement of the sample support plate. Thus, phases where the relative speed between sample support plate and laser spot is zero alternate with phases where the relative speeds are not zero. All the correction voltages are also changed in each case. If the movement speed of the sample support plate 13, the spacing between the sample sites (a, b, c, d), and the acquisition rate of mass spectra are correctly coordinated, the sample support plate 13 can be moved from one end of the sample coating through to the other end without stopping and at uniform speed. This tech-nique can be used in imaging mass spectrometry in particular, and also for other analytical tasks with high sample density. This general movement of the laser spot position on slowly moving sample support plates can be superimposed by a movement to raster the sample, as described below in some more detail.

Figure 5:
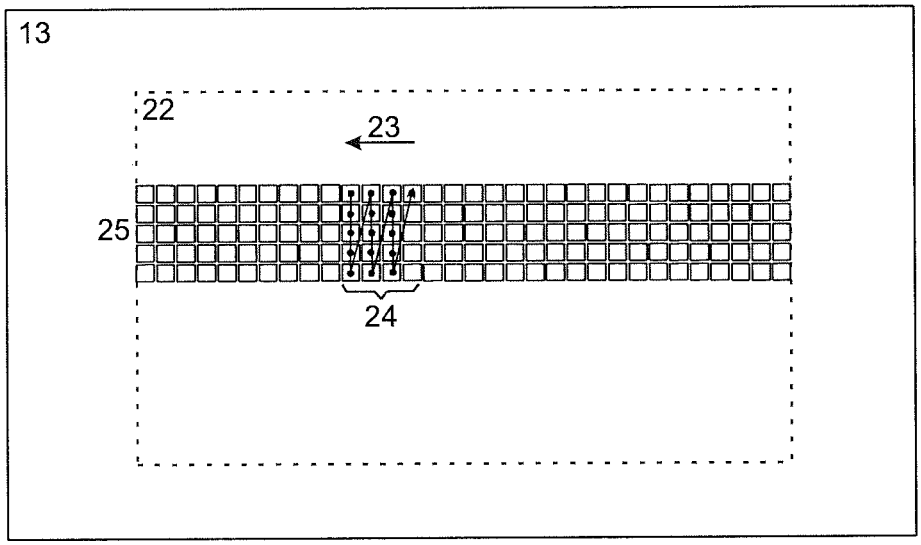
FIG. 5 shows that, if the sample support plate 13 with a larger sample area 22 moves uniformly and slowly in direction 23, it is also possible to analyze sample sites in several tracks 25 side by side in one movement sequence of the sample support plate. The positional control for the laser spot follows the movement pattern 24, with a stop at each sample site in each case, symbolized by dots here.

On moving support plates, it is possible not only to measure sample sites in linear sequence one after the other, but also to scan sample sites two-dimensionally, as schematically shown in FIG. 5. To this end, the laser spot must not only be simply made to linearly follow the movement 23 of the sample support plate 13 and switched back linearly, it must also be moved laterally in a pattern 24, with a stop at every sample site (depicted symbolically by dots in FIG. 5). For imaging mass spectrometry, for example, several pixel tracks 25 can thus be scanned side by side in one movement sequence of the sample support plate if these tracks can be reached by the posi-tional control. The next bunch of tracks can then be scanned as the sample support plate 13 moves back; but it may be more favorable in terms of the positional precision of the pixels to move the sample support plate 13 back quickly and to acquire the mass spectra of all the tracks in the same direction of movement. At each sample site, a much finer movement pattern of the laser spot, not shown in FIG. 5, for the layered ablation of the sample site according to FIG. 3 can be superim-posed on the coarse movement pattern 24.

The optimum position of the laser spot or the laser spot pattern relative to the axis of the ion optics must first be determined, however. The rapid positional control can also be used here for the automatic, program-controlled determination of the optimum position of the laser spots, which is defined by the highest sensitivity of the mass spectrometer achieved thereby, in particular with no deflection by the deflection plate pairs 16, 17. For this purpose, it is expedient to use special samples which deliver time-of-flight spectra of absolutely constant intensity over many hours and millions of laser shots. Such samples are known: flat droplets of peptides dissolved in glycerin can be used for this, for example. To maintain a uniform ion signal with these glycerin samples, it is particularly favorable to always image the laser spot onto precisely the same position on the droplet. New analyte molecules continuously diffuse through the liquid to this location as a fresh supply. To use these samples, the laser beam should therefore be made to follow with high precision as the sample support plate 13 is moved. In particular, this method also allows determining fully auto-matically the dependence of all correction voltages for deflections and additional accelerations on the spot position.

Figure 3:
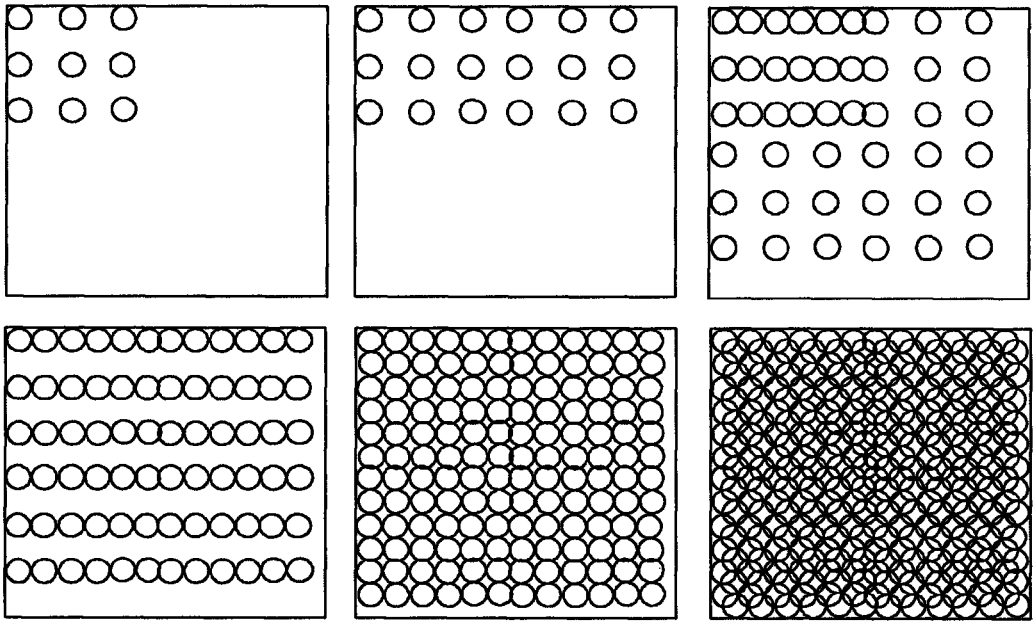
FIG. 3 shows how a first ablation layer can be uniformly ablated from a square sample area with 50-micrometer edge length using a pattern of nine laser spots and a total of 32 laser shots, if the individual laser spots of the pattern have a diameter of four micrometers and center separations of eight micrometers. Depending on the type of sample preparation, analyte ions can be supplied from depths of three to ten such ablation layers. With a triple scan, 96 individual time-of-flight spectra are obtained from the area; the spectra can then be summed and converted into a mass spectrum. Thus a sample area measuring one square centimeter yields 40,000 mass spectra, obtained at a 10 kHz laser shot rate from around 4 million individual single shot time-of-flight spectra, in only seven minutes.

The term "sample", from which a mass spectrum is acquired, has frequently been used here. This term requires a more detailed consideration and explanation. For the acquisition of individual time-of-flight spectra of a sample it is not advantageous to work with a laser spot or a laser spot pattern always at precisely the same location, because the sample is very quickly exhausted here; with thin section preparations this happens after around three to ten laser shots. It is therefore expedient to scan the available area of the sample in a raster pattern so that the sample is ablated uniformly. If possible, even the individual laser spots in a series of laser shots should not be set very close to each other, because this may cause excessive local heating of the sample material. It even should be avoided to set subsequent laser shots directly beside each other. A scanning pattern must therefore be selected which, as far as possible, avoids local overheating of the sample material and also brings about a uniform ablation of the sample across the available area. FIG. 3 shows the raster pattern for such a uniform ablation using a pattern of nine laser spots, where, in a square area of the sample surface with an edge length of precisely 50 micrometers, a layer of the sample is ablated quite uniformly with a total of 32 laser shots. This raster scanning is also made possible by the rapid positional control for the laser spot or the laser spot pattern. The utilization of a sample can thus be improved by using an ablation raster with the single laser spot or laser spot pattern which is better than techniques used to date. This applies both to imaging mass spectrometry and to the analysis of individually prepared samples. The above-described "following" of the laser spot on the sample site as the sample support plate moves uniformly must therefore be preferably superimposed with this scanning movement.

It is also possible to scan finer squares, but it is then unavoidable to position the laser spots side by side. A square with a 26-micrometer edge length can thus be scanned with the pattern of nine laser spots in eight laser shots. If the yield of the sample allows the ablation of five ablation layers, then 40 individual time-of-flight spectra can be summed to form a time-of-flight sum spectrum of this finer sample area in each case. Patterns of only four spots allow squares with an 18-micrometer edge length to be scanned. The ablation of finer squares increases the spatial resolution of the tissue image, albeit with detrimental effects on the detection limit and the signal-to-noise ratio; in many cases, finer pixels can later be added together again to form larger areas unless different mass spectra from very fine tissue structures surprisingly show up in the finer areas.

At the extreme, it is possible to use this method to measure a surface with very high resolution using individual spots of five-micrometer diameter, for example, and ten laser shots per site so that the mass spectra can also reproduce very fine structures. If no fine structures show up in this method, the data processing can later combine groups of these mass spectra to form pixels with lower spatial resolution again in order to achieve a better signal-to-noise ratio. Weak signals with low resolution and strong signals with high resolution can thus be derived from the data retrospec-tively.

The ablation pattern does not necessarily have to consist of square sample areas, however. For the acquisition of mass spectra from special plates for thin-layer chromatography, for example, it is expedient to acquire the mass spectra of a chromatographic trace with a wide, rectangular scanning pattern; the sample area for obtaining the individual time-of-flight spectra here can be 50 by 300 micrometers, for example. For the mass spectrometric measurement of plates from thin-layer chromatography, see U.S. Pat. No. 6,414,306.

Methods for the optimum preparation of samples and the optimum acquisition and pro-cessing of mass spectra for different analytical tasks are known to those skilled in the art and do not need to be reproduced here in detail. For imaging mass spectrometry on thin tissue sections, the sample preparations on special specimen slides with application of the layers of fine crystals of the matrix material are described in German patent documents DE 10 2006 019 530 B4 (M. Schürenberg et al.) and DE 10 2006 059 695 B3 (M. Schürenberg). German patent document DE 10 2010 051 810 (D. Suckau et al.) describes how a local digestion of proteins to form digest peptides can be carried out and used for the identification of the proteins of the thin tissue section. German patent document DE 10 2008 023 438 A1 shows how a mass spectrometric image is superimposed on a high-resolution visual image. German patent document DE 10 2010 009 853 shows how a largely noiseless image of the proteins on the thin tissue section can be generated by mathematical processing.

The rapid positional control for the laser spots can, furthermore, be used for a fully auto-matic adjustment of MALDI time-of-flight mass spectrometers. All the components of the ion optics can be independently adjusted in an optimum way here, at least if these ion-optical compo-nents, such as reflector and detector, are equipped with movement devices or electrically operated adjustment elements, at least for the period of the adjustment. The automatic adjustment of the components of the mass spectrometer saves testing time in the test bay; it is also very valuable later for servicing the mass spectrometers, which usually entails adjustment after carrying out cleaning or repair work.

The arrangement given here is not the only possible light-optical arrangement for generating the laser spots or the laser spot patterns; the invention should therefore not be limited to this arrangement. In addition, the embodiments have been described above with the use of ultraviolet light for ion desorption. The invention should not be limited to this embodiment, however. Other types of coherent light are also possible, in the infrared range of the spectrum, for example. Fur-thermore, the description was directed towards an ionization by matrix-assisted laser desorption. Again, the invention should not be limited to this special type of ionization, but should include all types of laser-induced ionization of samples on surfaces, starting with direct ionization by laser desorption (LD).

Although the present invention has been illustrated and described with respect to several preferred embodiments thereof, various changes, omissions and additions to the form and detail thereof, may be made therein, without departing from the spirit and scope of the invention.

What is claimed is:

1. Laser system for a time-of-flight mass spectrometer with ionization of samples on a sample support plate by matrix-assisted laser desorption, comprising:

a beam generation unit that generates laser beam pulses;

a mirror system that receives the laser beam pulses and provides reflected laser beam pulses for the positional control of the laser spots on the sample support plate;

a telescope that receives the reflected laser beam pulses and provides an expanded laser beam; and an optical lens system that receives and focuses the expanded laser beam into laser spots on the sample support plate.

2. The laser system of claim 1, wherein the mirror system comprises two mirrors to deflect the laser spot in both spatial directions.

3. The laser system of claim 2, further comprising a pattern generator that generates a laser spot pattern and is positioned between the beam generation unit and the mirror system.

4. Time-of-flight mass spectrometer with an ion source, an ion detector and a control unit for the positioning of a laser spot or a laser spot pattern on samples on a sample support plate, comprising an ion deflection unit which redirects ions which are produced outside the ion-optical axis of the ion source onto the ion detector, and a flight time correction unit for those ions which are generated outside the optical axis of the ion source.

5. The time-of-flight mass spectrometer of claim 4, wherein the flight time correction unit achieves a flight time correction by one of a correction to (i) a time delay of an ion acceleration, (ii) a voltage in a first acceleration region between the sample support plate and a first acceleration diaphragm, and (iii) a correction to the total ion acceleration.

6. Method for analyzing samples in a MALDI time-of-flight mass spectrometer comprising an ion source with a moveable sample support plate and a control unit for the positioning of a laser spot or a laser spot pattern on this sample support plate, wherein the sample support plate is moved continuously, and the control unit makes the position of the laser spot or the laser spot pattern for the acquisition of the individual time-of-flight spectra for a mass spectrum of a sample follow the movement of the sample support plate, so that ions are produced repeatedly from a same sample area on the sample support plate.

7. The method of claim 6, wherein, on conclusion of the acquisition of the individual time-of-flight spectra for a mass spectrum of a sample, the position of the laser spot or the laser spot pattern is directed onto a different sample and is made to follow this different sample area for the acquisition of individual time-of-flight spectra of this sample.

8. The method of claim 7, wherein ions which are generated from the sample area by laser spots or laser spot patterns outside the optical axis of the ion source are deflected by a deflection device onto the ion detector on their flight path through the mass spectrometer.

9. The method of claim 7, wherein ions which are generated from the sample area by laser spots or laser spot patterns outside the optical axis of the ion source are additionally accelerated by a device for additional acceleration so that their time of flight is equal to that of ions which are generated in the axis of the ion source.

10. Method for analyzing samples in a MALDI time-of-flight mass spectrometer which contains an ion source with a mobile sample support and a control unit for positioning a laser spot on the sample support, wherein the sample support is continuously moved in one spatial direction and the control unit moves the laser spot on the sample support in such a way that phases where the relative speed between laser spot and sample support plate is zero alternate with phases where the relative speeds are not equal to zero, so that ions are produced repeatedly from a same sample area on the sample support plate.

11. The method of claim 10, where the laser spot contains an intensity pattern, and the movements for positioning the laser spot on the sample support refer to a centroid of the intensity pattern.

12. The method of claim 11, where laser spot and sample support plate move parallel to each other but in opposite directions in the phases when the relative movement is not zero.

13. The method of claim 12, where the laser spot and the sample support plate move in different directions, not parallel to each other, in the phases when the relative speed is not zero.

* * * * *